US010923793B2

(12) United States Patent
Oonishi et al.

(10) Patent No.: US 10,923,793 B2
(45) Date of Patent: Feb. 16, 2021

(54) ANTENNA DEVICE, MANHOLE COVER EQUIPPED WITH ANTENNA DEVICE, AND POWER DISTRIBUTION PANEL EQUIPPED WITH SAME

(71) Applicant: Hitachi, Ltd., Tokyo (JP)

(72) Inventors: Masami Oonishi, Tokyo (JP); Kenichi Mizugaki, Tokyo (JP); Ryosuke Fujiwara, Tokyo (JP); Rintaro Katayama, Tokyo (JP)

(73) Assignee: HITACHI, LTD., Tokyo (JP)

( * ) Notice: Subject to any disclaimer, the term of this patent is extended or adjusted under 35 U.S.C. 154(b) by 71 days.

(21) Appl. No.: 16/276,652

(22) Filed: Feb. 15, 2019

(65) Prior Publication Data

US 2019/0267695 A1 Aug. 29, 2019

(30) Foreign Application Priority Data

Feb. 27, 2018 (JP) ..... JP2018-032980

(51) Int. Cl.
*H01Q 1/04* (2006.01)
*H01Q 1/46* (2006.01)
(Continued)

(52) U.S. Cl.
CPC ..... *H01Q 1/04* (2013.01); *E02D 29/14* (2013.01); *H01Q 1/2233* (2013.01); *H01Q 1/40* (2013.01);
(Continued)

(58) Field of Classification Search
CPC .... H01Q 21/065; H01Q 21/061; H01Q 13/10; H01Q 13/106; H01Q 1/243; H01Q 1/40; H01Q 21/0006; H01Q 9/0407; H01Q 13/08; H01Q 13/22; H01Q 15/08; H01Q 19/06; H01Q 1/246; H01Q 1/3233; H01Q 1/38; H01Q 21/0025; H01Q 21/005; H01Q 21/06; H01Q 21/064; H01Q 21/28;
(Continued)

(56) References Cited

U.S. PATENT DOCUMENTS 4,675,685 A 6/1987 Finken
6,369,769 B1 4/2002 Nap et al.
(Continued)

FOREIGN PATENT DOCUMENTS

JP 2008-109556 A 5/2008

OTHER PUBLICATIONS

Extended European Search Report received in corresponding European Application No. 19158092.7 dated Aug. 30, 2019.
(Continued)

*Primary Examiner* — Monica C King
(74) *Attorney, Agent, or Firm* — Mattingly & Malur, PC

(57) ABSTRACT

An object of the present invention is to improve an antenna for IoT services intended for things that constitute an internal space. There is provided an antenna device including an antenna and a dielectric body. In an internal space which is constituted by plural faces including a first face which is an electrically conductive body, the antenna device is adapted to have a shape to be fit inside a hole in the first face. The antenna device is installed, not protruding from the hole to an outer space. The antenna and the dielectric body are placed in series between the internal space and the outer space.

9 Claims, 7 Drawing Sheets

(51) Int. Cl.

| | |
|---|---|
| ***H01Q 1/22*** | (2006.01) |
| ***H01Q 1/40*** | (2006.01) |
| ***E02D 29/14*** | (2006.01) |
| ***H01Q 19/06*** | (2006.01) |
| *H01Q 9/28* | (2006.01) |
| *H01Q 9/06* | (2006.01) |
| *H01Q 9/04* | (2006.01) |
| *H01Q 25/00* | (2006.01) |
| *H01Q 15/08* | (2006.01) |

(52) U.S. Cl.
CPC ..... *H01Q 1/46* (2013.01); *H01Q 19/06* (2013.01); *H01Q 9/0407* (2013.01); *H01Q 9/065* (2013.01); *H01Q 9/285* (2013.01); *H01Q 15/08* (2013.01); *H01Q 25/001* (2013.01)

(58) Field of Classification Search
CPC .. H01Q 9/0435; H01Q 13/02; H01Q 13/0275; H01Q 13/203; H01Q 19/08; H01Q 1/125; H01Q 1/2216; H01Q 1/2283; H01Q 1/523; H01Q 21/0043; H01Q 21/24; H01Q 25/00; H01Q 25/008; H01Q 3/2635; H01Q 5/40; H01Q 7/00; H01Q 9/0457; H01Q 9/285; H01Q 9/30; H01Q 13/18; H01Q 1/04; H01Q 1/2233; H01Q 1/2266; H01Q 1/26; H01Q 1/36; H01Q 1/42; H01Q 1/46; H01Q 1/48; H01Q 21/0081; H01Q 21/0087; H01Q 21/08; H01Q 23/00; H01Q 25/001; H01Q 25/02; H01Q 3/06; H01Q 3/08; H01Q 3/26; H01Q 3/30; H01Q 9/0414; H01Q 9/0442; H01Q 9/065; H01Q 9/42
See application file for complete search history.

(56) References Cited

U.S. PATENT DOCUMENTS

| | | | | |
|---|---|---|---|---|
| 2002/0057220 | A1 | 5/2002 | Sabet et al. | |
| 2004/0150575 | A1 | 8/2004 | Lizalek et al. | |
| 2017/0263999 | A1 | 9/2017 | Miyoshi et al. | |
| 2017/0294711 | A1* | 10/2017 | Kim ..... | H01P 3/08 |

OTHER PUBLICATIONS

Chi Sang You et al., "Design and Fabrication of Composite Smart Structures for Communication, Using Structural Resonance of Radiated Field", Smart Materials and Structures, Apr. 1, 2005, pp. 441-448, vol. 14, No. 2.

Krishna, D. D. et al., "Compact Dual Band Slot Loaded Circular Microstrip Antenna with a Superstrate", Progress in Electromagnetics Research, Jan. 1, 2008, pp. 245-255, vol. 83.

* cited by examiner

ANTENNA DEVICE, MANHOLE COVER EQUIPPED WITH ANTENNA DEVICE, AND POWER DISTRIBUTION PANEL EQUIPPED WITH SAME

CROSS-REFERENCE TO RELATED APPLICATION

The present application claims priority from Japanese application JP 2018-032980, filed on Feb. 27, 2018, the contents of which is hereby incorporated by reference into this application.

BACKGROUND

The present invention relates to an antenna device, a manhole cover equipped with an antenna device, and a power distribution panel equipped with same.

As Internet of Things (IoT) that are recently underway with the aim of connecting diversified things to a network, services exist in which sensors are installed on diversified things and information acquired by the sensors are collected by radio communication. For such IoT services, how to reduce power consumption is an important challenge. For this purpose, improvement of antennas to enable radio communication with lower transmission power is also required.

IoT services extend to, e.g., sewerage or the like and there is an idea to install an antenna within a manhole cover instead of an internal space of a manhole. Japanese Unexamined Patent Application Publication No. 2008-109556 describes a "manhole antenna using a chip antenna whose structure is small enough to be inserted into an air hole of a manhole cover, the chip antenna having a wide directionality of radio waves radiated therefrom and a large electric field intensity, and the manhole antenna adapted to be installable within the manhole cover with its base portion being fit inside an air hole of the manhole cover".

SUMMARY

In Japanese Unexamined Patent Application Publication No. 2008-109556, installing an antenna within a manhole cover is described, but only the use of a chip antenna is described and a technical aspect regarding wavelength and directionality of radio waves that are used for radio communication is far from being disclosed sufficiently.

An object of the present invention is to improve an antenna for IoT services intended for things that constitute an internal space.

An antenna device according to a representative aspect of the present invention is an antenna device including an antenna and a dielectric body. In an internal space which is constituted by plural faces including a first face which is an electrically conductive body, the antenna device is adapted to have a shape to be fit inside a hole in the first face. The antenna device is installed, not protruding from the hole to an outer space. The antenna and the dielectric body are placed in series between the internal space and the outer space.

According to the present invention, it is possible to improve an antenna for IoT services intended for things that constitute an internal space.

DETAILED DESCRIPTION

Figure 1:
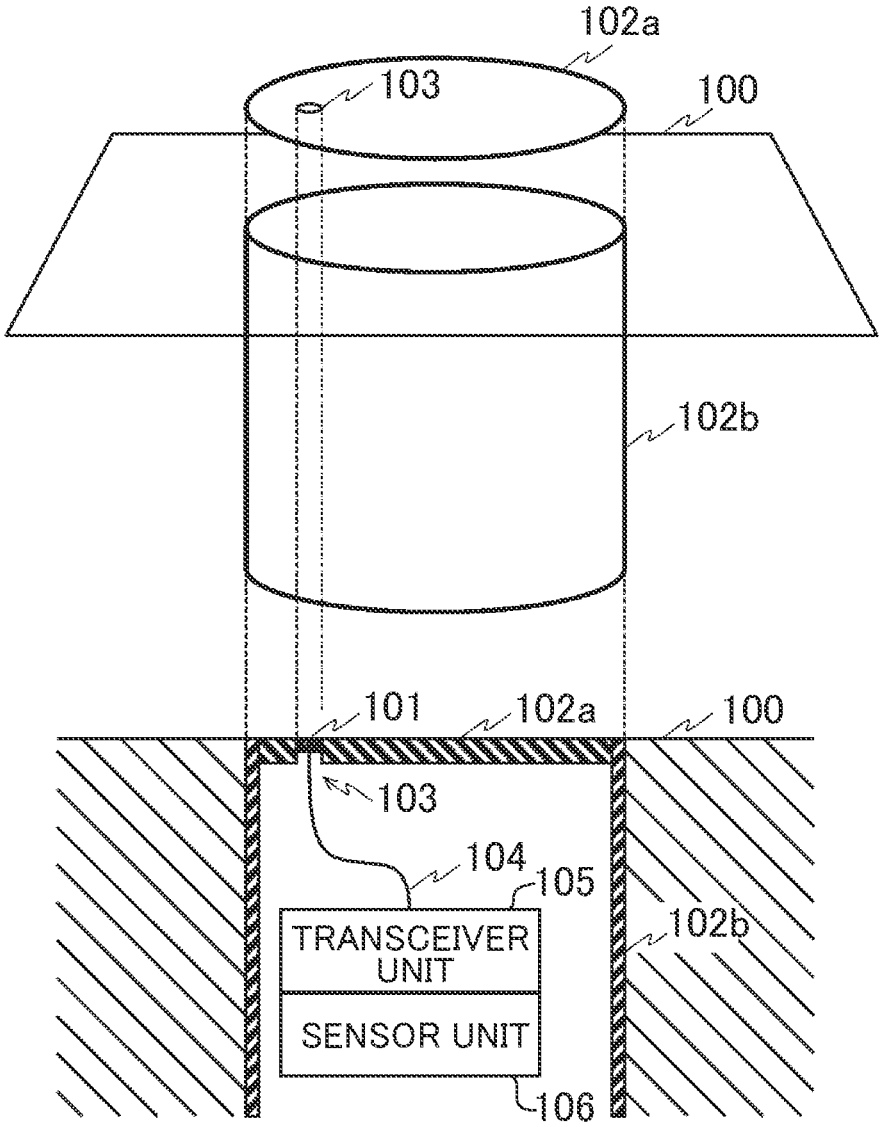
FIG. 1 is a diagram depicting an example in which an antenna device is installed in a manhole according to a first embodiment.

In the following, an antenna device that is an embodiment for carrying out the present invention will be described as an embodiment example with reference to the drawings. Now, in the drawings, common or identical components are assigned identical reference designators and their duplicated description is omitted.

First Embodiment

FIG. 1 is a diagram depicting an example in which a small antenna device is installed in a manhole according to a first embodiment. The manhole is comprised of a manhole cover 102*a* and a body 102*b* and its whole other than the manhole cover 102*a* is buried under the ground surface 100.

As depicted in FIG. 1, the manhole cover 102*a* may be removable from the manhole main body 102 and may be an electrically conductive body. The manhole main body 102*b* may be an electrically conductive body or insulating body which is substantially cylindrical and there is a space through which a matter will pass inside it.

However, the structure of the manhole cover 102*a* and the manhole main body 102*b* is not limited to the example in FIG. 1. When the manhole cover 102*a* is installed over the manhole main body 102*b* (the cover is closed), an internal space is formed by the manhole main body 102*b* and the manhole cover 102*a* in the manhole.

The manhole cover 102*a* is also provided with a maintenance operational hole 103 for, for example, opening and closing the cover and accessing equipment such as a meter and an opening and closing device which are situated inside the manhole main body 102*b*. The maintenance operational hole 103 penetrates the manhole cover 102*a* and the manhole internal space and an outer space join in the maintenance operational hole 103.

A transceiver unit 105 and a sensor unit 106 are installed inside the manhole main body 102*b* and a radio-frequency signal from the transceiver unit 105 is transmitted to a small antenna device 101 installed in the maintenance operational hole 103 through a radio-frequency cable 104. The transmitted radio-frequency signal is radiated to the outer space of the manhole by the small antenna device 101.

Here, the small antenna device 101 that is installed in the maintenance operational hole 103 should, preferably, have a shape to be fit into the maintenance operational hole 103 and should, preferably, be installed within the thickness of the manhole cover 102*a*. It is also preferable that the size of the small antenna device 101 is smaller than one-fourth of the wavelength of the radio-frequency signal that is radiated by the small antenna device 101. The small antenna device 101 will be further described with FIGS. 3A to 12.

Although the example in which the small antenna device 101 separates from the transceiver unit 105 and the sensor unit 106 and is connected with these units by the radio-frequency cable 104 is presented in FIG. 1, the small antenna device 101, the transceiver unit 105, and the sensor unit 106 may be integrated in a single structure and installed in the maintenance operational hole 103.

In addition, the small antenna device 101 and the transceiver unit 105 may be integrated in a single structure and the sensor unit 106 may be separated from them. The transceiver unit 105 and the sensor unit 106 may be connected by a signal cable. The sensor unit 106 may be installed on an object to be measured which is away from the manhole cover 102.

By bringing the small antenna device 101 installed in the maintenance operational hole 103 in contact with the outer space of the manhole, the influence of gain decreased by making the antenna smaller becomes less than that of gain decreased when the antenna was installed in the internal space of the manhole. In consequence, more electric power is radiated from the manhole and signal transmission in a wider range becomes possible.

In addition, the small antenna device 101 is installed with a contact plane between the small antenna device 101 and the other space not protruding from the maintenance operational hole 103 into the outer space. This makes the antenna device insulated from the influence of a physical impact in a case where the manhole is present on a sidewalk or road.

Second Embodiment

Figure 2:
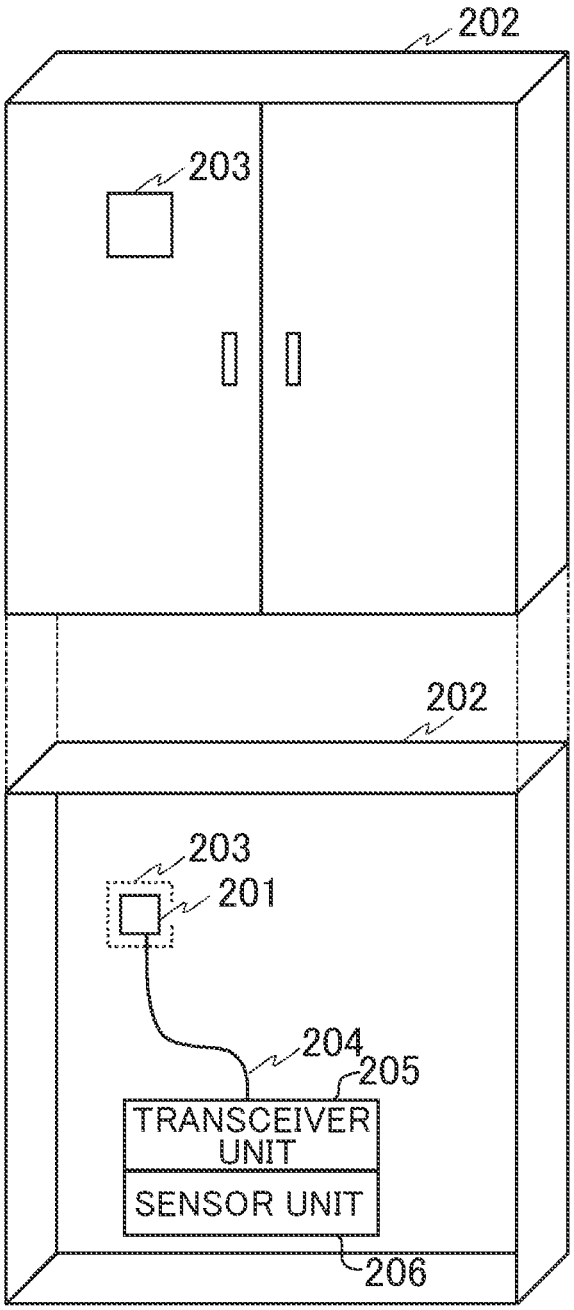
FIG. 2 is a diagram depicting an example in which an antenna device is installed in a power distribution panel according to a second embodiment.

FIG. 2 is a diagram depicting an example in which a small antenna device is installed in a power distribution panel according to a second embodiment. The power distribution panel is comprised of a power distribution panel main body 202 and a window 203. The power distribution panel main body 202 is provided with the window 203 for seeing inside the power distribution panel main body 202 to read meters and check its interior.

The power distribution panel main body 202 may be an electrically conductive body. As depicted in FIG. 2, the power distribution panel main body 202 is of a box shape and an internal space is formed inside the power distribution panel main body 202. The window 203 may be provided on a substantially vertical face of the power distribution panel main body 202 or a substantially horizontal face thereof. The window 203 may be a glass plate or a transparent plastic plate or may be a simply hollow space like a hole.

If the window 203 is a glass plate (transparent plastic plate), a space that is in contact with its surface opposite to a surface of the glass plate (transparent plastic plate) which is in contact with the internal space is an outer space. If the window 203 is a simple hollow space; supposing that the window 203 is a glass plate, a space that expands from a position that is in contact with an imaginary glass plate surface opposite to its surface which is in contact with the internal space in a direction away from the glass plate may be an outer space.

Now, if the window 203 is a glass plate (transparent plastic plate); it can be stated in another way that the glass plate (transparent plastic plate) is set in a hole of the power distribution panel main body 202. If the window 203 is a simple hollow space, it can be stated in another way that the window 203 is a hole.

A transceiver unit 205 and a sensor unit 206 are installed inside the power distribution panel main body 202 and a radio-frequency signal from the transceiver unit 205 is transmitted to a small antenna device 201 installed within the window 230 by a radio-frequency cable 204. The transmitted radio-frequency signal is radiated to the outer space by the small antenna device 201.

Here, the small antenna device 201 that is installed within the window 203 should, preferably, have a shape to be fit into the window 203. If the window 203 is a glass plate, the small antenna device 201 should, preferably, be installed on an inner surface of the glass plate. If the window 203 is not a glass plate, the small antenna device 201 should, preferably, be installed at the position of the window 203 on one of the faces that constitute the internal space.

It is also preferable that the size of the small antenna device 201 is less than one-fourth of the wavelength of the radio-frequency signal that is radiated by the small antenna device 201. The small antenna device 201 will be further described with FIGS. 3A to 12.

As is the case with FIG. 1, although the example in which the small antenna device 201 separates from the transceiver unit 205 and the sensor unit 206 and is connected with these units by the radio-frequency cable 204 is presented, the small antenna device 201, the transceiver unit 205, and the sensor unit 206 may be integrated in a single structure and installed within the window 203.

In addition, the small antenna device 201 and the transceiver unit 205 may be integrated in a single structure and the sensor unit 106 may be separated from them. The transceiver unit 205 and the sensor unit 206 may be connected by a signal cable. The sensor unit 206 may be installed on an object to be measured which is away from the window 203.

By bringing the small antenna device 201 installed within the window 203 in proximity to the outer space, the influence of gain decreased by making the antenna smaller becomes less than that of gain decreased when the antenna was simply installed inside the power distribution panel main body 202. In consequence, more electric power is radiated from the power distribution panel main body 202 and signal transmission in a wider range becomes possible.

In addition, the small antenna device 201 is installed, not protruding from the window 203 into the outer space. This makes the antenna device insulated from the influence of a physical impact caused by opening and closing the door of the power distribution panel main body 202 or interference by external buildings among others.

Third Embodiment

Figure 3A:
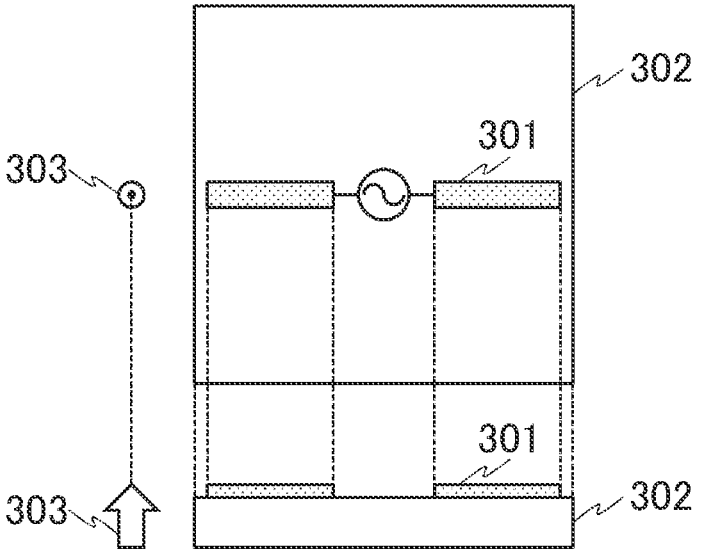
FIG. 3A is a diagram depicting an example of an antenna device according to a third embodiment.

FIG. 3A is a diagram depicting an example of an antenna device according to a third embodiment and the example in which a dipole antenna is configured on a dielectric substrate. The antenna device depicted in FIG. 3A is such that an antenna pattern 301 (antenna) is configured on the dielectric substrate 302 and is the small antenna device 101 described in the first embodiment or the small antenna device 201 described in the second embodiment.

The antenna device should, preferably, be installed in such an orientation that there is an outer space in a direction pointed by an arrow 303. Or, the antenna device should, preferably, be installed in such an orientation that there is not an internal space in a direction pointed by the arrow 303. In addition, although the dielectric substrate 302 is depicted as a substantially rectangular cubic body in the example in FIG. 3A, no limitation to this shape is intended.

Figure 3B:
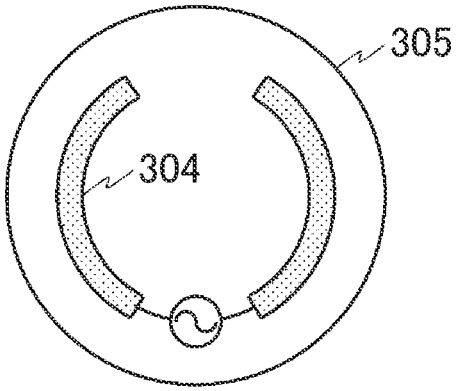
FIG. 3B is a diagram depicting another example of an antenna device according to the third embodiment.

For example, if the maintenance operational hole 103 of the manhole cover 102*a* depicted in FIG. 1 is cylindrical, a dielectric substrate 305 may be formed in a substantially columnar shape, as is depicted in FIG. 3B. An antenna pattern 304 may also be formed along the circumference of the substantially columnar substrate according to the shape of the dielectric substrate 305, as is depicted in FIG. 3B. Furthermore, the antenna pattern on the dielectric substrate 302 or the dielectric substrate 305 may be formed in an alphabet Z shape or the like.

The dielectric substrates 302, 305 have a dielectric constant (relative permittivity) that is higher than air. By configuring the antenna patterns 301, 304 on the dielectric substrates 302, 305, as depicted in FIGS. 3A and 3B, it would become possible to reduce the antenna pattern size owing to a wavelength shortening effect produced by that dielectric constant. In other words, the antenna gain less decreases even with reduced antenna pattern size.

Fourth Embodiment

Figure 4:
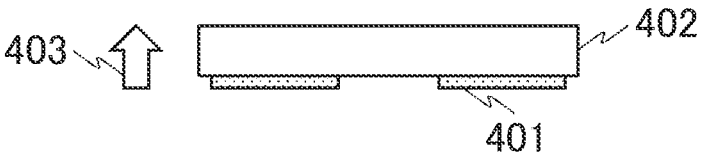
FIG. 4 is a diagram depicting an example of an antenna device according to a fourth embodiment.

FIG. 4 is a diagram depicting an example of an antenna device according to a fourth embodiment and another example in which a dipole antenna is configured on a dielectric substrate. The antenna device depicted in FIG. 4 is such that an antenna pattern 401 is configured on the dielectric substrate 402.

In the antenna device according to the fourth embodiment, a positional relation between the dielectric substrate and the antenna pattern differs from that in the antenna device according to the third embodiment. That is, the antenna device depicted in FIG. 4 should, preferably, be installed in such an orientation that there is an outer space in a direction pointed by an arrow 403. Or, the antenna device should, preferably, be installed in such an orientation that there is not an internal space in a direction pointed by the arrow 403.

By configuring the antenna pattern 401 on the dielectric substrate 402, as depicted in FIG. 4, it would become possible to reduce the antenna pattern size owing to the wavelength shortening effect produced by the dielectric constant, as is the case for the third embodiment. Additionally, by placing the dielectric substrate 402 nearer to the outer space toward the direction of the outer space than the antenna pattern 401, it would become possible to provide an effect in which the directionality of radio waves being radiated to the outer space spreads in a direction perpendicular to the direction of the arrow 403.

Now, because radio waves which are radiated from the antenna pattern 401 in a direction opposite to the direction of the arrow 403 are useless, the antenna device may be configured such that a reflective plate is installed in a position away from the antenna pattern 401 by one-fourth wavelength in a direction opposite to the direction of the arrow 403 to reflect useless radio waves in a direction toward the dielectric substrate 402.

Fifth Embodiment

Figure 5:
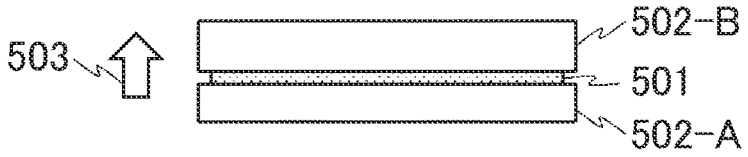
FIG. 5 is a diagram depicting an example of an antenna device according to a fifth embodiment.

FIG. 5 is a diagram depicting an example of an antenna device according to a fifth embodiment and the example in which an antenna pattern (dipole antenna) is configured between two pieces of dielectric substrates with differing dielectric constants. The antenna device depicted in FIG. 5 is such that the antenna pattern 501 is configured on a dielectric substrate 502-A with a dielectric constant A and, moreover, a dielectric substrate 502-B with a dielectric constant B is configured on top of the antenna pattern.

By configuring the antenna pattern 501 in touching with the dielectric substrate 502-A and the dielectric substrate 502-B, as depicted in FIG. 5, it would become possible to reduce the antenna pattern size owing to the wavelength shortening effect produced by the dielectric constants, as is the case for the third embodiment.

Moreover, by setting the dielectric constant A of the dielectric substrate 502-A and the dielectric constant B of the dielectric substrate 502-B to have a relation that dielectric constant B>dielectric constant A, it would become possible to provide an effect in which the directionality of radio waves being radiated from the antenna pattern 501 in a direction toward the dielectric substrate 502-B spreads in a direction perpendicular to the intrinsic directionality of the antenna pattern 501.

The antenna device depicted in FIG. 5 is installed in such an orientation that there is an outer space in a direction pointed by an arrow 503 or installed in such an orientation that there is not an internal space in the direction pointed by the arrow 503. Thereby, it would become possible to provide an effect in which the directionality of radio waves being radiated to the outer space spreads in a direction perpendicular to the direction of the arrow 503.

Sixth Embodiment

Figure 6:
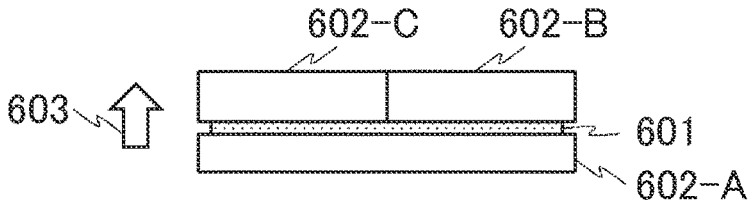
FIG. 6 is a diagram depicting an example of an antenna device according to a sixth embodiment.

FIG. 6 is a diagram depicting an example of an antenna device according to a sixth embodiment and the example in which an antenna pattern (dipole antenna) is configured in touching with three pieces of dielectric substrates with differing dielectric constants. The antenna device depicted in FIG. 6 is such that the antenna pattern 601 is configured on a dielectric substrate 602-A with a dielectric constant A and, moreover, on top of the antenna pattern, a dielectric substrate 602-B with a dielectric constant C and a dielectric substrate 602-C with a dielectric constant C are configured with both the substrates being in contact with the antenna pattern 601.

By configuring the antenna pattern 601 in touching with the dielectric substrates 602-A, 602-B, and 602-C, as depicted in FIG. 6, it would become possible to reduce the antenna pattern size owing to the wavelength shortening effect produced by the dielectric constants, as is the case for the third embodiment.

Furthermore, by setting the dielectric constant A of the dielectric substrate 602-A, the dielectric constant B of the dielectric substrate 602-B, and the dielectric constant C of the dielectric substrate 602-C to have a relation that dielectric constant C>dielectric constant B>dielectric constant A, it would become possible to provide an effect in which the directionality of radio waves being radiated from the antenna pattern 601 in a direction toward the dielectric substrates 602-B, 602-C spreads in a direction perpendicular to the intrinsic directionality of the antenna pattern 601 and an effect of distributing the radio waves in a direction toward the dielectric substrate 602-C.

In the configuration depicted in FIG. 6, it is preferable that the dielectric substrate 602-C is placed toward a desired direction to orient the directionality of radio waves being radiated from the antenna device and the dielectric substrate 602-B is placed toward a direction opposite to the desired direction. The dielectric substrate 602-C may be placed in a direction toward a device that receives radio waves being radiated from the antenna device.

Although the example in which the dielectric substrate 602-B and the dielectric substrate 602-C appear to have the same shape is presented in FIG. 6, no limitation to this is intended and the dielectric substrate 602-B and the dielectric substrate 602-C may have differing shapes.

The antenna device depicted in FIG. 6 is installed in such an orientation that there is an outer space in a direction pointed by an arrow 603 or installed in such an orientation that there is not an internal space in the direction pointed by the arrow 603. Thereby, it would become possible to provide an effect in which the directionality of radio waves being radiated to the outer space is distributed in a direction toward the dielectric substrate 602-C in a direction perpendicular to the direction of the arrow 603.

Seventh Embodiment

Figure 7:
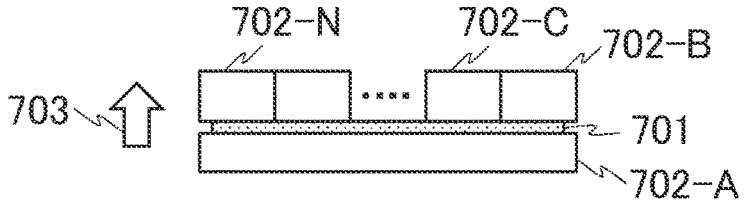
FIG. 7 is a diagram depicting an example of an antenna device according to a seventh embodiment.

FIG. 7 is a diagram depicting an example of an antenna device according to a seventh embodiment and the example in which an antenna pattern (dipole antenna) is configured in touching with N pieces of dielectric substrates (A, B, C, . . . , N, which denotes N pieces) with differing dielectric constants.

The antenna device depicted in FIG. 7 is such that the antenna pattern 701 is configured on a dielectric substrate 702-A with a dielectric constant A and, moreover, on top of the antenna pattern, dielectric substrates 702-B to 702-N with dielectric constants B to N respectively are configured with each substrate being in contact with the antenna pattern 701.

By configuring the antenna pattern 701 in touching with the dielectric substrates 702-A to 702-N, as depicted in FIG. 7, and setting the substrates' dielectric constants to have a relation that dielectric constant N> . . . >dielectric constant C>dielectric constant B>dielectric constant A, it would become possible to provide an effect in which the directionality of radio waves being radiated from the antenna pattern 701 in a direction toward the dielectric substrates 702-B to 702-N spreads in a direction perpendicular to the intrinsic directionality of the antenna pattern 701 and an effect of distributing the radio waves in a direction toward the dielectric substrate 702-N.

Especially, in a case where there are four or more pieces of substrates (N>4), it is enabled to control the directionality of radio waves being radiated so that the radio waves will be distributed, more oriented in a direction toward the dielectric substrate 702-N, as compared with the configuration described in the sixth embodiment. Now, it is preferable that the dielectric substrates 702-N to 702-B in a direction in which the radio waves are so distributed and oriented each have a length (width) that is smaller than one-fourth of the wavelength of radio waves being radiated.

The antenna device depicted in FIG. 7 is installed in such an orientation that there is an outer space in a direction pointed by an arrow 703 or installed in such an orientation that there is not an internal space in the direction pointed by the arrow 703. Thereby, it would become possible to provide an effect in which the directionality of radio waves being radiated to the outer space is distributed in a direction toward the dielectric substrate 702-N in a direction perpendicular to the direction of the arrow 703.

Eighth Embodiment

Figure 8:
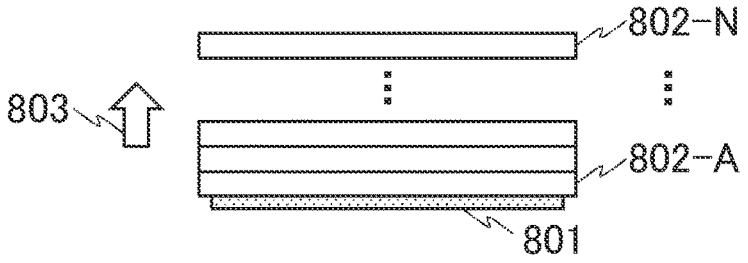
FIG. 8 is a diagram depicting an example of an antenna device according to an eighth embodiment.

FIG. 8 is a diagram depicting an example of an antenna device according to an eighth embodiment and the example in which N pieces of dielectric substrates (A, . . . , N, which denotes N pieces) with differing dielectric constants are configured over an antenna pattern (dipole antenna).

The antenna device depicted in FIG. 8 is such that dielectric substrates 802-A to 802-N with dielectric constants A to N respectively are configured, each being layered over the antenna pattern 801. It is preferable that the dielectric substrates 802-A to 802-N each have a plate thickness that is thinner than one-fourth of the wavelength of radio waves being radiated from the antenna pattern 801.

By configuring the antenna pattern 801 together with the dielectric substrates 802-A to 802-N, as depicted in FIG. 8, and setting the substrates' dielectric constants to have a relation that dielectric constant N> . . . >dielectric constant A, an effect is provided in which the directionality of radio waves being radiated from the antenna pattern 801 in a direction toward the dielectric substrates 802-A to 802-N spreads in a direction perpendicular to the intrinsic directionality of the antenna pattern 801, as is the case for the fourth embodiment.

Especially, in a case where there are two or more pieces of substrates, it is enabled to provide an effect in which, as radio waves being radiated pass through the multiple dielectric substrates 802-A to 802-N, their directionality spreads gradually, thereby spreading more in the direction perpendicular to the intrinsic directionality of the antenna pattern 801, as compared with the configuration described in the fourth embodiment.

The antenna device depicted in FIG. 8 is installed in such an orientation that there is an outer space in a direction pointed by an arrow 803 or installed in such an orientation that there is not an internal space in the direction pointed by the arrow 803. Thereby, it would become possible to provide an effect in which the directionality of radio waves being radiated to the outer space spreads in a direction perpendicular to the direction of the arrow 803.

Ninth Embodiment

Figure 9:
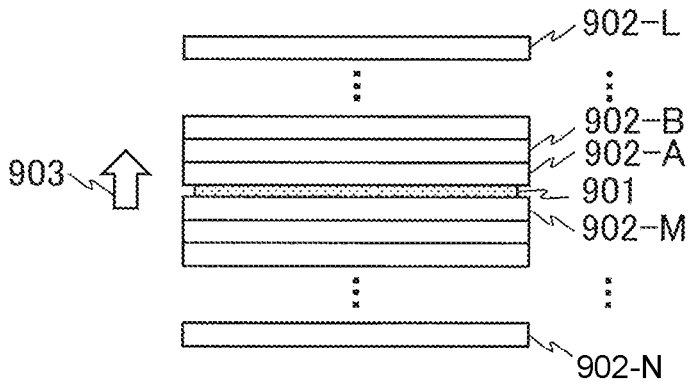
FIG. 9 is a diagram depicting an example of an antenna device according to a ninth embodiment.

FIG. 9 is a diagram depicting an example of an antenna device according to a ninth embodiment and the example in which an antenna pattern (dipole antenna) is configured together with (L+N) pieces of dielectric substrates (A, . . . , L, which denotes L pieces and M, . . . , N, which denotes N pieces, where L and N may be either the same number of pieces or differing numbers of pieces) with differing dielectric constants.

The antenna device depicted in FIG. 9 is such that dielectric substrates 902-A to 902-L with dielectric constants A to L respectively are configured, each being layered over the antenna pattern 901, and dielectric substrates 902-M to 902-N with dielectric constants M to N respectively are configured, each being layered under a surface of a dielectric substrate 902-A, opposite to its surface being in contact with a dielectric substrate 902-B, and across the antenna pattern 901.

It is preferable that the dielectric substrates 902-A to 902-N each have a thickness that is less than one-fourth of the wavelength of radio waves being radiated from the antenna pattern 901. In addition, the dielectric constants of the dielectric substrates 902-A to 902-N have a relation below: dielectric constant L> . . . >dielectric constant A>dielectric constant M> . . . >dielectric constant N.

By configuring the antenna pattern 901 together with the dielectric substrates 902-A to 902-N with such dielectric constants, as depicted in FIG. 9, an effect is provided in which the directionality of radio waves being radiated from the antenna pattern 901 in a direction toward the dielectric substrates 902-A to 902-L spreads in a direction perpendicular to the intrinsic directionality of the antenna pattern 901, as is the case for the eighth embodiment and it would become possible to reduce the antenna pattern size owing to the wavelength shortening effect produced by those dielectric constants, as is the case for the third embodiment.

The antenna device depicted in FIG. 9 is installed in such an orientation that there is an outer space in a direction pointed by an arrow 903 or installed in such an orientation that there is not an internal space in the direction pointed by the arrow 903. Thereby, it would become possible to provide an effect in which the directionality of radio waves being radiated to the outer space spreads in a direction perpendicular to the direction of the arrow 903.

Tenth Embodiment

Figure 10:
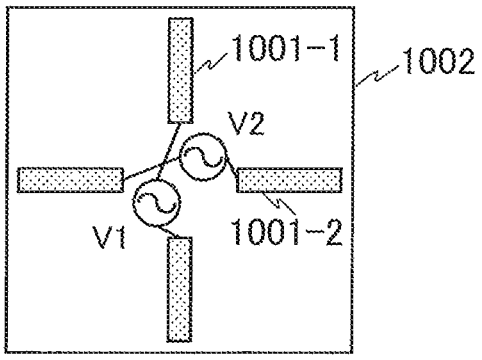
FIG. 10 is a diagram depicting an example of an antenna device according to a tenth embodiment.

FIG. 10 is a diagram depicting an example of an antenna device according to a tenth embodiment and the example in which the antenna device is configured using two dipole antennas that get crossed. The antenna device depicted in FIG. 10 is such that a dipole antenna pattern 1001-1 and a dipole antenna pattern 1001-2 are configured on a dielectric substrate 1002; the dipole antenna pattern 1001-1 and the dipole antenna pattern 1001-2 are configured to bisect each other at substantially right angles physically.

Two signals V1 and V2 which are supplied to the dipole antenna pattern 1001-1 and the dipole antenna pattern 1001-2 respectively, as depicted in FIG. 10, have differing phases. Thereby, it is enabled to change directionality in a direction in parallel with a surface of the dielectric substrate 1002 on which the dipole antenna pattern 1001-1 and the dipole antenna pattern 1001-2 contact.

In addition, a phase difference between the signals V1 and V2 may range from 0 to 90 degrees. If the phase difference is 90 degrees, circularly polarized waves are generated and a uniform directionality can be realized as the direction in the direction in parallel with the surface of the dielectric substrate 1002. Now, instead of the dielectric substrate 1002, one of dielectric substrate configurations described in the fourth to ninth embodiments may be adopted.

Eleventh Embodiment

Figure 11:
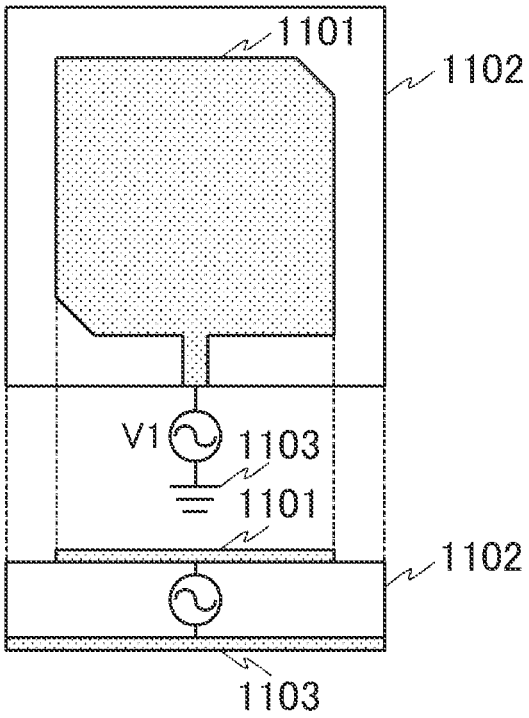
FIG. 11 is a diagram depicting an example of an antenna device according to an eleventh embodiment.

FIG. 11 is a diagram depicting an example of an antenna device according to an eleventh embodiment and then example in which the antenna device is configured using a patch antenna that is capable of generating circularly polarized waves. The antenna device depicted in FIG. 11 is such that an antenna pattern 1101 is configured on a dielectric substrate 1102 and a grounding pattern 1103 is configured on a surface of the dielectric substrate 1102 opposite to its surface being contact with the antenna pattern 1101.

It is preferable that the antenna pattern 1101 is smaller than the dielectric substrate 1102 and the grounding pattern 1103 has the same shape as the dielectric substrate 1102. As is the case for the tenth embodiment, it is enabled to change directionality in a direction in parallel with the surface of the dielectric substrate 1102 on which the antenna pattern 1101 contacts by circularly polarized waves. Additionally, radio waves being radiated from the antenna pattern 1101 in a direction toward the grounding pattern 1103 can be reduced by the grounding pattern 1103.

Now, instead of the dielectric substrate 1102, one of dielectric substrate configurations described in the fifth to ninth embodiments may be adopted. In addition, the antenna pattern 1001 may be of the shape of a slot antenna or a microstrip antenna, not the shape of a patch antenna.

Figure 12:
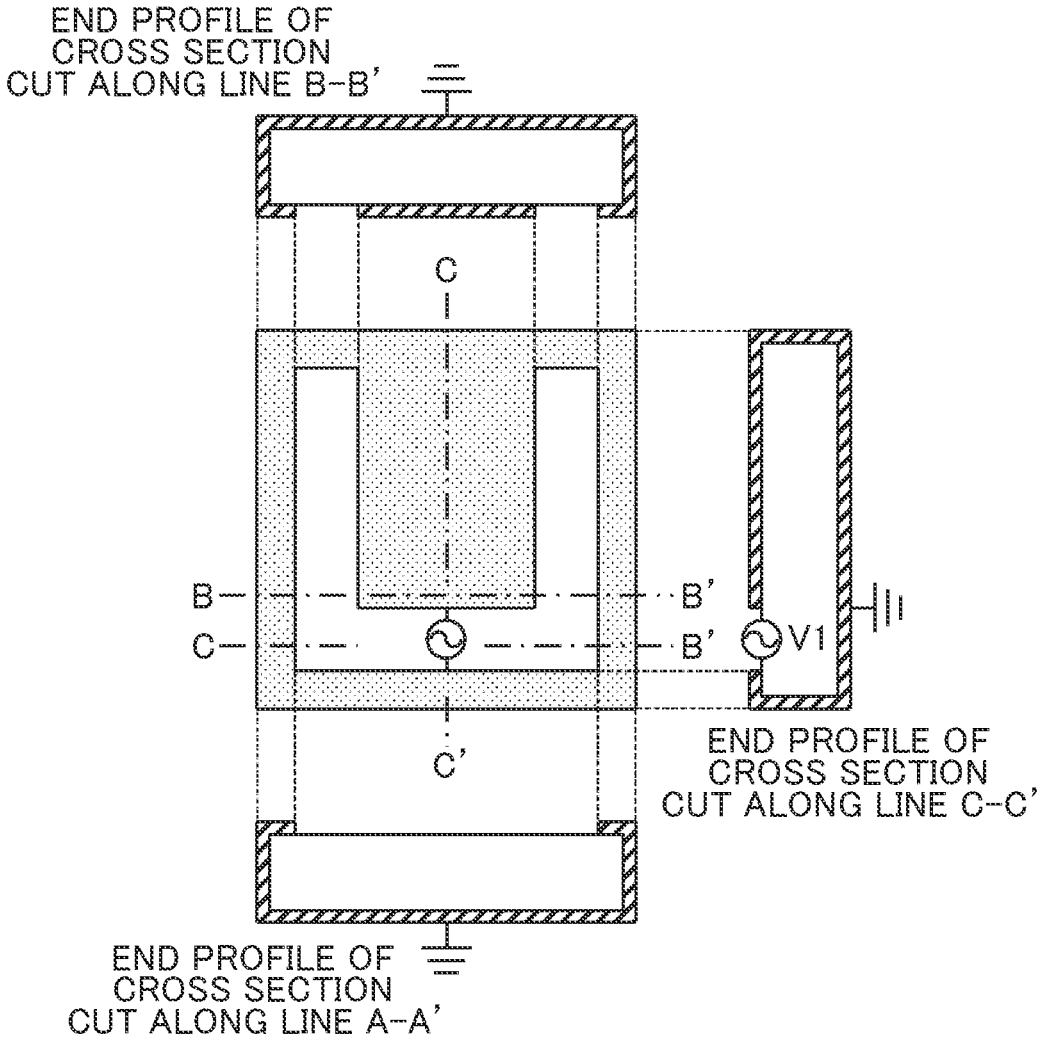
FIG. 12 is a diagram depicting another example of an antenna device according to the eleventh embodiment.

FIG. 12 is a diagram depicting another example of an antenna device according to the eleventh embodiment and the example in which the antenna device is configured using a slot antenna. Although the example in which an internal part surrounded by conductive bodies having holes serving as slots and forming a substantially square shape appears to be a space is presented in FIG. 12, a dielectric body like a dielectric substrate may be included in the internal part surrounded by the conductive bodies. In addition, a slot antenna may be configured in another form, not limited to the example in FIG. 12.

Embodiments described hereinbefore should not be construed to be limited to the examples described in the respective embodiments. In addition to combinations of embodiments described explicitly in the respective embodiments, a part of an embodiment may be replaced by a part of another embodiment or a part of another embodiment may be added to an embodiment.

What is claimed is:

1. An antenna device comprising:

an antenna;

a first dielectric body; and a second dielectric body wherein, in an internal space which is defined at one end by an electrically conductive body, the antenna device is adapted to have a shape to be fit inside a hole in the electrically conductive body, the electrically conductive body being interposed between the internal space and an outer space, wherein the antenna device is installed so as to not protrude from the hole to the outer space, and wherein the first dielectric body is exposed to the internal space, the second dielectric body is exposed to the outer space and the antenna is disposed between the first dielectric body and the second dielectric body.

2. The antenna device according to claim 1, wherein the second dielectric body has a higher dielectric constant than the first dielectric body.

3. The antenna device according to claim 2, further comprising:

a third dielectric body adjacent to the second dielectric body, wherein the the third dielectric body has a higher dielectric constant than the second dielectric body, wherein the second dielectric body and the third dielectric body are each in contact with the antenna, and wherein the outer space is set in a first order position, the second dielectric body and the third dielectric body are set in a second order position, the antenna is set in a third order position, the first dielectric body is set in a fourth order position, and the internal space is set in a fifth order position relative to each other.

4. The antenna device according to claim 2, further comprising:

N pieces of dielectric bodies adjacent to the second dielectric body, wherein the N pieces of dielectric bodies have dielectric constants that gradually increase in order from a first piece of dielectric body to an N-th piece of dielectric body, wherein the second dielectric body and the N pieces of dielectric bodies are each in contact with the antenna, and wherein the outer space is set in a first order position, the second dielectric body and the N pieces of dielectric bodies are set in a second order position, the antenna is set in a third order position, the first dielectric body is set in a fourth order position, and the internal space is set in a fifth order position relative to each other.

5. An antenna device comprising:

an antenna;

a first plurality of plate-like dielectric bodies; and a second plurality of plate-like dielectric bodies, wherein, in an internal space which is defined at one end by an electrically conductive body, the antenna device is adapted to have a shape to be fit inside a hole in the electrically conductive body, the electrically conductive body being interposed between the internal space and an outer space, wherein the antenna device is installed so as to not protrude from the hole to the outer space, and wherein the first plurality of plate-like dielectric bodies are positioned in order from the internal space to the antenna device, the second plurality of plate-like dielectric bodies are positioned in order from the antenna to the outer space, whereby the antenna is disposed between the first plurality of plate-like dielectric bodies and the second plurality of plate-like dielectric bodies, wherein the dielectric constants of the first and second plurality of plate-like elements increase in order from one of the first plurality of plate-like dielectric bodies closest to the internal space to one of the second plurality of plate-like dielectric bodies closest to the outer space.

6. The antenna device according to claim 1, wherein the antenna includes a plurality of dipole antennas, and wherein signals with differing phases are supplied to the plurality of dipole antennas respectively.

7. The antenna device according to claim 1, wherein the antenna is a patch antenna, a slot antenna, or a microstrip antenna.

8. A manhole cover equipped with an antenna device, wherein the manhole cover has a hole and is installed over a manhole main body to constitute an internal space together with the manhole main body, wherein the antenna device comprises:

an antenna;

a first dielectric body; and a second dielectric body wherein, the antenna device is adapted to have a shape to be fit inside the hole of the manhole cover, the manhole cover being interposed between the internal space and an outer space, wherein the antenna device is installed so as to not protrude from the hole to the outer space, and wherein the first dielectric body is exposed to the internal space, the second dielectric body is exposed to the outer space and the antenna is disposed between the first dielectric body and the second dielectric body.

9. A power distribution panel equipped with an antenna device, wherein the power distribution panel has a window for seeing an internal space of the power distribution panel, wherein the antenna device comprises:

an antenna;

a first dielectric body; and a second dielectric body wherein, the antenna device is adapted to have a shape to be fit within the window of the power distribution panel, the window being interposed between the internal space and an outer space, wherein the antenna device is installed so as to not protrude from the window to the outer space, and wherein the first dielectric body is exposed to the internal space, the second dielectric body is exposed to the outer space and the antenna is disposed between the first dielectric body and the second dielectric body.

* * * * *